US009070529B2

(12) United States Patent
Tamura et al.

(10) Patent No.: US 9,070,529 B2
(45) Date of Patent: Jun. 30, 2015

(54) RADIATION GENERATING APPARATUS AND RADIATION IMAGING APPARATUS

(75) Inventors: Miki Tamura, Kawasaki (JP); Shuji Aoki, Yokohama (JP); Yoshihiro Yanagisawa, Fujisawa (JP); Kazuyuki Ueda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 395 days.

(21) Appl. No.: 13/483,193

(22) Filed: May 30, 2012

(65) Prior Publication Data

US 2013/0016810 A1 Jan. 17, 2013

(30) Foreign Application Priority Data

Jul. 11, 2011 (JP) ..... 2011-152757

(51) Int. Cl.
*H01J 35/08* (2006.01)
*H01J 35/12* (2006.01)
(Continued)

(52) U.S. Cl.
CPC ..... *H01J 35/08* (2013.01); *H01J 35/12* (2013.01); *H01J 35/14* (2013.01); *H01J 35/16* (2013.01); *H01J 35/18* (2013.01); *H01J 2235/06* (2013.01); *H01J 2235/087* (2013.01); *H01J 2235/1204* (2013.01); *H01J 2235/1216* (2013.01);
(Continued)

(58) Field of Classification Search
CPC ..... H01J 35/12; H01J 35/16; H01J 35/18; H01J 2235/087; H01J 2235/1216; H01J 2235/122; H01J 2235/166; H01J 2235/168; H01J 2235/18; H01J 2235/183
USPC ..... 378/139, 140, 161
See application file for complete search history.

(56) References Cited

U.S. PATENT DOCUMENTS 5,651,045 A * 7/1997 Pouvesle et al. ..... 378/119
6,320,936 B1 * 11/2001 Holland et al. ..... 378/140
(Continued)

FOREIGN PATENT DOCUMENTS

JP 62-004100UA 1/1987
JP 2002-373800 12/2002
(Continued)

OTHER PUBLICATIONS

Office Action issued on Mar. 3, 2015, in counterpart Japanese patent application 2011-152757 (see above for statement of relevance).

*Primary Examiner* — Glen Kao
(74) *Attorney, Agent, or Firm* — Fitzpatrick, Cella, Harper & Scinto

(57) ABSTRACT

In a radiation imaging apparatus, an envelope has a first window for transmitting radiation and is filled with an insulating liquid, and a radiation tube in the envelope has, at a position facing the first window, a second window for transmitting the radiation, and a shielding member. A solid insulating member is arranged between the shielding member and the inner wall of the envelope, and an opening is formed at a position on the insulating member corresponding to the first window. The shortest distance from the shielding member to the first window or the inner wall of the envelope through the opening of the insulating member without the insulating member is made to be longer than the shortest distance from the shielding member to the first window or the inner wall of the envelope through the insulating member, thereby improving withstand voltage performance without reducing an radiation amount.

17 Claims, 4 Drawing Sheets

(51) Int. Cl.

| | |
|---|---|
| ***H01J 35/14*** | (2006.01) |
| ***H01J 35/16*** | (2006.01) |
| ***H01J 35/18*** | (2006.01) |
| ***H05G 1/06*** | (2006.01) |

(52) U.S. Cl.
CPC .... *H01J2235/122* (2013.01); *H01J 2235/1295* (2013.01); *H01J 2235/16* (2013.01); *H01J 2235/167* (2013.01); *H05G 1/06* (2013.01)

(56) References Cited

U.S. PATENT DOCUMENTS

| | | | | |
|---|---|---|---|---|
| 7,889,844 | B2 | 2/2011 | Okunuki et al. | 378/122 |
| 2005/0163284 | A1 | 7/2005 | Inazuru | 378/108 |
| 2006/0165220 | A1* | 7/2006 | Takahashi et al. | 378/109 |
| 2009/0010393 | A1* | 1/2009 | Klinkowstein et al. | 378/140 |
| 2009/0052626 | A1 | 2/2009 | Inazuru et al. | 378/140 |
| 2010/0329429 | A1* | 12/2010 | Okunuki et al. | 378/122 |
| 2011/0188633 | A1* | 8/2011 | Ohta et al. | 378/102 |
| 2011/0235783 | A1 | 9/2011 | Ogura et al. | 378/112 |

FOREIGN PATENT DOCUMENTS

| | | |
|---|---|---|
| JP | 2003-332098 | 11/2003 |
| JP | 2006-010335 | 1/2006 |
| JP | 2007-080568 | 3/2007 |
| JP | 2007-265981 | 10/2007 |
| WO | 2007/043390 | 4/2007 |

* cited by examiner

RADIATION GENERATING APPARATUS AND RADIATION IMAGING APPARATUS

FIELD OF THE INVENTION

The present invention relates to a radiation generating apparatus which is applicable to non-destructive X-ray photography or the like in the fields of medical equipment and industrial equipment, and a radiation imaging apparatus in which the radiation generating apparatus is used.

DESCRIPTION OF THE RELATED ART

In general, a radiation tube accelerates, at a high voltage, electrons emitted from an electron emitting source, and then bombards a target with the accelerated electrons, thereby generating radiation such as X-rays or the like. At this time, the radiation is generated in all directions. In the circumstances, a transmission-type radiation tube in which shielding members are arranged on electron-incident side of the target and a radiation-emitting side has been proposed to shield redundant radiation (Japanese Patent Application Laid-Open No. 2007-265981). In the radiation tube like this, it is unnecessary to cover, by a shielding member such as a lead member or the like, the entirety of the radiation tube or the entirety of an envelope holding therein the radiation tube, whereby it is possible to achieve reduction of size and weight of the overall apparatus.

To cause a radiation imaging apparatus to generate suitable radiation, it is necessary to irradiate a target with a high-energy electron beam by applying a high voltage, of 40 to 150 kilovolts, between the electron emitting source and the target. For this reason, high voltage differences of several tens of kilovolts or more resultingly occur between the electron emitting source and the target and between the radiation tube and the envelope thereof. Here, as a means for enabling the apparatus to withstand such high voltages (i.e., providing it with a suitable "voltage-withstand" performance), a construction in which the portion between the radiation tube and the envelope thereof is filled with an insulating oil, and a construction in which an insulating member is arranged within the envelope of the radiation tube have been proposed (Japanese Patent Application Laid-Open No. 2007-080568).

In the transmission-type radiation tube, it is possible to further reduce the radiation generating apparatus in size and weight by adopting a neutral grounding system as a voltage applying means. Here, it should be noted that a "neutral grounding system" is one in which the voltage of the target is set to $+(Va-\alpha)$ volts, and the voltage of the electron emitting source is set to $-\alpha$ volts (where $Va>\alpha>0$). Although the value of "$\alpha$" is an arbitrary value to be selected within the range of $Va>\alpha>0$, this value is generally selected to be close to $Va/2$. When the neutral grounding system like this is adopted, the absolute value of the voltage relative to ground can be made small, whereby a creeping distance which is necessary to secure the desired voltage-withstand performance can be shortened. Thus, it is possible to reduce the apparatus in size and weight.

Meanwhile, a high voltage difference occurs between the radiation shielding member electrically connected to the target and the envelope generally grounded to have ground potential. Here, as a method for enabling the apparatus to withstand the voltage between the radiation shielding member and the envelope, the present inventors found that a method of drenching the transmission-type radiation tube in an insulating liquid and further arranging the insulating member in the envelope so as to face a radiation passing hole of the radiation shielding member was effective.

However, when the insulating member is arranged so as to face the radiation passing hole of the radiation shielding member, a transmission hole to be used to extract the radiation from inside the envelope is covered by the insulating member, and thus the amount of the radiation capable of being extracted from the envelope is reduced. Consequently, as a method of preventing such a reduction of the amount of the radiation that can be extracted, it is conceivable to use a method of providing an opening for passing the radiation in the insulating member. However, in this method, a high potential difference occurs between the radiation shielding member and the envelope. For this reason, when such an opening is provided in the insulating member, the voltage-withstand performance is reduced at the provided opening. Thus, there is a case where an electric discharge occurs the apparatus is driven during a long time or the like.

Here, Japanese Patent Application Laid-Open No. 2007-080568 discloses that the insulating member is arranged around the radiation tube but not at the radiation emitting hole. However, in the X-ray generating apparatus disclosed in Japanese Patent Application Laid-Open No. 2007-080568, since the reflection-type radiation tube is used, a high potential difference is not likely to occur between the radiation tube and the envelope thereof at the opening of the insulating member.

In a radiation generating apparatus in which the radiation tube is drenched with insulating liquid, the present inventors aim to provide a radiation generating apparatus which can provide the desired voltage-withstand performance even when presented with a high voltage, without reducing the amount of radiation that can be extracted for use, and such that the size and weight of the apparatus can be reduced, and to provide a radiation imaging apparatus in which such radiation generating apparatus is used.

SUMMARY OF THE INVENTION

In order to achieve such an object as described above, the present disclosure is provided of a radiation generating apparatus which comprises: an envelope which has a first window through which radiation is transmitted; a radiation tube which is held in the envelope, and has, at a position facing the first window, a second window through which the radiation is transmitted; a shielding member which has a radiation passing hole which is in communication with the second window; an insulating liquid which is filled between the envelope and the radiation tube; and a solid insulating member which is arranged between the shielding member and an inner wall of the envelope, and has an opening at a position corresponding to the first window, where the shortest length of a supposed straight line stretching from the shielding member to the first window or the inner wall of the envelope through the opening of the insulating member without intersecting the insulating member is longer than the shortest length of a supposed straight line stretching from the shielding member to the first window or the inner wall of the envelope as intersecting the insulating member.

The first window which is provided on the envelope in which the insulating liquid has been filled and the second window which is provided on the radiation tube which is arranged within the envelope may be arranged so as to face each other, with the insulating member arranged between the shielding member which has the radiation passing hole which is in communication with the second window and the inner wall of the envelope. Here, since the insulating member has the opening of the insulating member at the position corresponding to the first window, it is possible to prevent radiation emitted from the radiation tube being absorbed by the insulating member and thus prevent a reduction in the amount of the radiation. Further, since the solid insulating member is provided, the withstand voltage performance is improved at the opening of the insulating member. Furthermore, since the shortest length of the supposed straight line stretching from the shielding member to the first window or the inner wall of the envelope through the opening of the insulating member without intersecting the insulating member is made longer than the shortest length of the supposed straight line stretching from the shielding member to the first window or the inner wall of the envelope as intersecting the insulating member, it is possible to suppress a deterioration in the voltage-withstand performance at the opening of the insulating member. Thus, the voltage-withstand performance as between the radiation tube and the envelope can be obtained even if the distance between the shielding member and the envelope is shortened, whereby it is possible to achieve reduction of size and weight of the apparatus.

Further features of the present invention will become apparent from the following description of exemplary embodiments with reference to the attached drawings.

DESCRIPTION OF THE EMBODIMENTS

Hereinafter, preferred embodiments of the present invention will be described in detail with reference to the accompanying drawings. However, the present invention is not limited to these embodiments. Incidentally, it should be noted that, with respect to parts not specifically illustrated or described in the present application, widely known or publicly known technique in a technical field to which the present invention belongs is applied.

First Embodiment

Figure 1A:
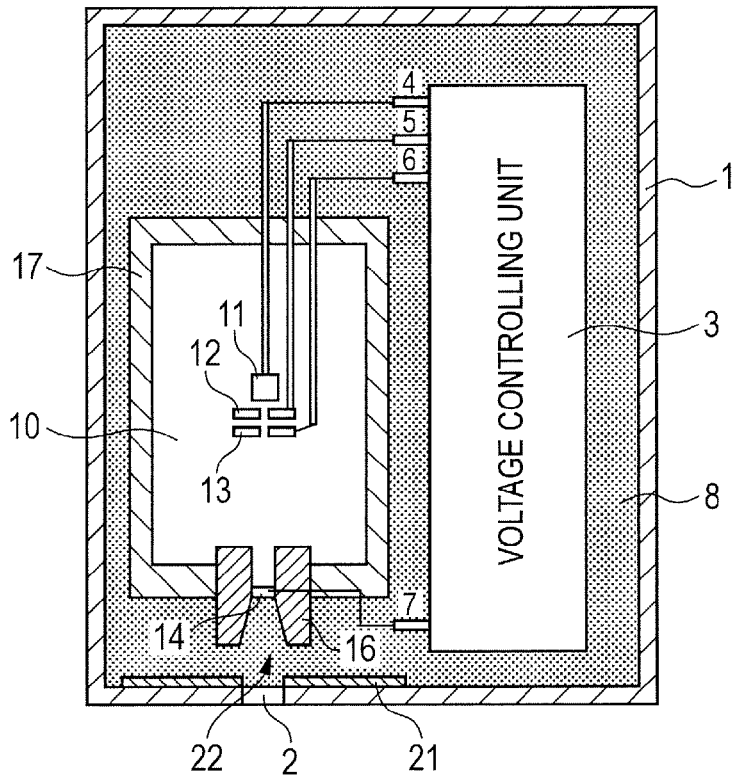
FIGS. 1A, 1B and 1C are schematic diagrams illustrating a radiation generating apparatus according to a first embodiment of the present invention.
Figure 1B:
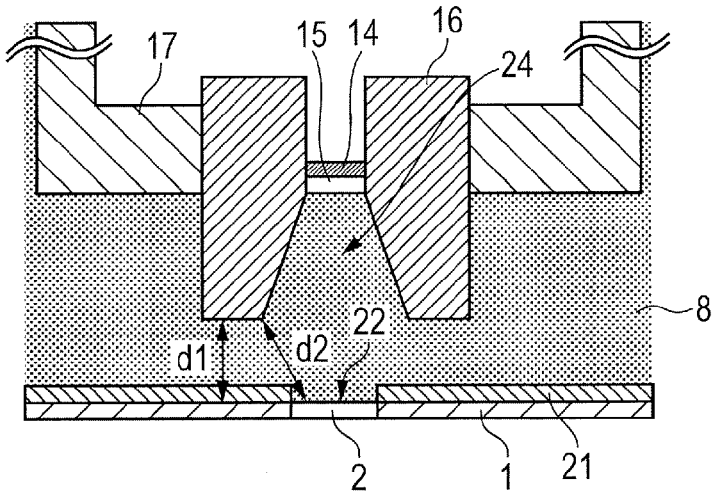
Figure 1C:
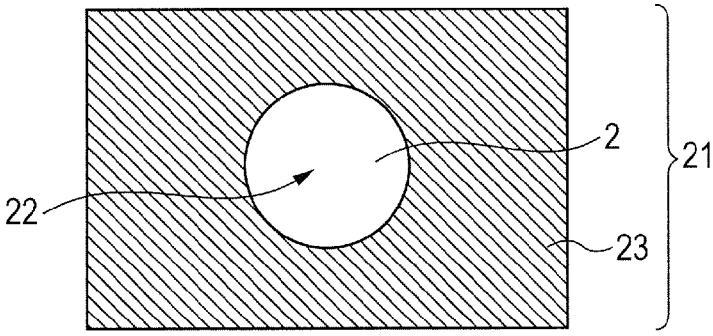

First of all, the first embodiment of the present invention will be described with reference to FIGS. 1A, 1B and 1C. More specifically, FIG. 1A is the cross-section schematic diagram illustrating a radiation generating apparatus according to the present embodiment, FIG. 1B is the enlarged cross-section schematic diagram illustrating a peripheral part of a radiation shielding member (called a shielding member, hereinafter) 16 and an insulating member 21 both illustrated in FIG. 1A, and FIG. 1C is the schematic diagram of the insulating member 21 and a first window 2 for transmitting radiation which are viewed from the side of the shielding member 16 all illustrated in FIG. 1A.

The radiation generating apparatus according to the present embodiment is equipped with a transmission-type radiation tube 10 (called a radiation tube, hereinafter), and the radiation tube 10 is held within an envelope 1.

Here, the radiation tube 10 includes a vacuum container 17, an electron emitting source 11, a target 14, a second window 15 for transmitting a radiation, and the shielding member 16.

In the envelope which has the radiation tube 10 inside, extra space is filled with an insulating liquid 8. Incidentally, a voltage controlling unit (voltage controlling means) 3 which consists of a circuit board, an insulating transformer and the like (all not illustrated) may be provided within the envelope 1 as in the present embodiment. In a case where the voltage controlling unit 3 is provided, for example, voltage signals are applied from the voltage controlling unit 3 to the radiation tube 10 respectively through terminals 4, 5, 6 and 7, whereby it is possible to control generation of the radiation.

It is desirable that the envelope 1 has a sufficient intensity as a container and also has excellent heat dissipation. More specifically, a metallic material such as brass, iron, stainless steel or the like is used as the envelope.

The insulating liquid 8 only has to have an electrical insulation property. For example, it is desirable that an electrically insulating oil which serves as an insulating medium and a cooling medium of the radiation tube 10 is used as the insulating liquid. Here, it is desirable that a mineral oil, a silicone oil or the like is used as the electrical insulating oil. In addition, a fluorine-based electrical insulating liquid is also usable as the insulating liquid 8.

The first window 2, which is used to transmit and extract the radiation from the envelope, is provided in the envelope 1. Thus, the radiation emitted from the radiation tube 10 is further emitted outward through the first window 2. Here, glass, aluminum, beryllium, polycarbonate or the like is used as the first window 2.

In the envelope 1, the solid insulating member 21 is arranged between the shielding member 16 and the inner wall of the envelope 1 so that the solid insulating member 21 faces a radiation passing hole 24 of the shielding member 16, in order to secure the necessary voltage-withstand performance as between the shielding member 16 and the envelope 1. Here, a material having high performance as electrical insulation and also the voltage-withstand performance of which is high is desirable as the material for the insulating member 21. More specifically, polyimide, polycarbonate, glass epoxy or the like can be used as the material for the insulating member. In general, although an insulating liquid such as an electrical insulating oil has high electrical insulation and high voltage-withstand performance, there is a case where the voltage-withstand performance deteriorates due to impurities, moisture, air bubbles or the like which are included in the insulating liquid or which occur due to degradation over time. For this reason, it is possible, by providing the insulating member 21 in the form of a solid, to maintain the high voltage-withstand performance with greater certainty. Here, from the viewpoint of securing the voltage-withstand performance between the shielding member 16 and the envelope 1, it is suitable that the thickness of the insulating member 21 is about 0.1 mm to 10 mm Incidentally, a material whose electrical insulation characteristics are higher than those of the insulating liquid 8 may be used as the insulating member 21. In any case, in the insulating member 21, an opening 22 is provided at the position corresponding to the first window 2. Thus, it is possible to prevent the amount of radiation (e.g., X-rays) emitted from the radiation tube 10 being reduced due to being absorbed by the insulating member 21.

An extraction electrode 12 and a lens electrode 13 may be provided in the radiation tube 10 as in the present embodiment. In a case where the extraction electrode and the lens electrode are provided, electrons are first emitted from the electron emitting source 11 by the electric field formed by the extraction electrode 12, the emitted electrons are converged by the lens electrode 13, and the converged electrons bombard the target 14, whereby the radiation is generated.

The vacuum container 17, which is used to maintain the inside of the radiation tube 10 as a vacuum, is composed of a glass material, a ceramic material or the like. The vacuum in the vacuum container 17 may be about $10^{-4}$ Pa to $10^{-8}$ Pa. Further, a not-illustrated exhaust tube may be provided on the vacuum container 17. Here, in a case where the exhaust tube is provided on the vacuum container, for example, after exhausting the inside of the vacuum container 17 for vacuumization through the exhaust tube, it is possible to vacuumize the inside of the vacuum container 17 by sealing a part of the exhaust pipe. In addition, a not-illustrated getter may be arranged within the vacuum container 17 to maintain the inside thereof as a vacuum. Incidentally, the opening is provided on the vacuum container 17, and the shielding member 16 having the radiation passing hole 24 is joined to the opening. Therefore, the vacuum container 17 is tightly sealed up when the second window 15 is joined to the inner wall of the radiation passing hole 24 of the shielding member 16.

In the vacuum container 17, the electron emitting source 11 is arranged so as to face the target 14. Here, a tungsten filament, a hot cathode such as an impregnated cathode, or a cold cathode such as a carbon nanotube or the like can be used as the electron emitting source 11. The extraction electrode 12 is arranged in the vicinity of the electron emitting source 11. Thus, the electrons emitted by the electric field formed by the extraction electrode 12 are converged by the lens electrode 13, and the converged electrons bombard the target 14, whereby the radiation is generated. At this time, a voltage Va to be applied between the electron emitting source 11 and the target 14 is approximately 40 kV to 150 kV, although this will differ depending on the intended use of the radiation.

The target 14 is arranged on the electron emitting source side (i.e., the inner side) of the second window 15. It is desirable that a material having a high melting point and high radiation generation efficiency is used for the target 14. For example, tungsten, tantalum, molybdenum or the like can be used as the material of the target.

The second window 15, which supports the target 14 and through which at least a part of the radiation generated in the target 14 is transmitted, is provided within the radiation passing hole 24 of the shielding member 16. Here, as the material for the second window 15, it is desirable to use a material which is capable of supporting the target 14, a relatively small tendency to absorb the radiation generated in the target 14, and high thermal conductivity for enabling it quickly to release heat generated in the target 14. It is possible to use, for example, diamond, silicon nitride, aluminum nitride or the like.

The shielding member 16 has, at the outer side of the vacuum container 17, the radiation passing hole 24 which is in communication with the second window 15, so as to shield unnecessary radiation included in the radiation emitted from the target 14. More specifically, the shielding member 16 is joined to the opening of the vacuum container 17, and the second window 15 is joined to the inner wall at the inner end of the radiation passing hole 24. Here, the target 14 does not need to be joined to the inner wall of the radiation passing hole 24. At the inner side of the vacuum container 17, the shielding member 16 has an electron passing path which is in communication with the second window 15. In FIGS. 1A to 1C, an electron emitted from the electron emitting source 11 travels to the target 14 through the electron passing path, and thus the radiation is generated in the target 14. At this time, since the shielding member 16 extends from the target 14 toward the electron emitting source 11, unnecessary radiation scattered from the target 14 toward the electron emitting source are shielded by the shielding member 16. Moreover, since the shielding member 16 extends from the second window 15 toward the first window 2, the radiation transmitted through the second window 15 passes through the radiation passing hole 24. Thus, unnecessary radiation is shielded by the shielding member 16.

As the material for the shielding member 16, it is desirable to use a material which has a high radiation absorption factor and high thermal conductivity. For example, a metallic material such as tungsten, tantalum or the like can be used as the material for the shielding member. Incidentally, it is suitable that the thickness of the shielding member 16 is 3 mm or more, so as to shield unnecessary radiation.

Here, it is assumed that the shortest distance which stretches from the shielding member 16 to the first window 2 or the inner wall of the envelope 1 as intersecting the insulating member 21 is d1, and that the shortest distance which stretches from the shielding member 16 to the first window 2 or the inner wall of the envelope 1 through the opening 22 of the insulating member 21 without intersecting the insulating member 21 is d2. That is, the shortest length of a supposed straight line stretching from the shielding member 16 to the first window 2 or the inner wall of the envelope 1 through the opening of the insulating member 21 without intersecting the insulating member 21 is equivalent to the shortest distance d2, and the shortest length of a supposed straight line stretching from the shielding member 16 to the first window 2 or the inner wall of the envelope 1 as intersecting the insulating member 21 is equivalent to the shortest distance d1. In the present embodiment, the shape of the shielding member 16 is as illustrated in FIGS. 1A and 1B so as to satisfy that the shortest distance d2 is longer than the shortest distance d1. Here, since the solid insulating member 21 is arranged between the shielding member 16 and the inner wall of the envelope 1, the voltage-withstand performance on a non-opening portion 23 of the insulating member 21 (that is, a portion other than where the hole is) is improved as compared with a case where the insulating member 21 is not used. On the other hand, the voltage-withstand performance at the opening 22 of the insulating member 21 is low as compared with the non-opening portion 23 of the insulating member 21. However, since the shortest distance d2 is longer than the shortest distance d1, it is possible to suppress deterioration in the voltage-withstand performance at the opening 22 of the insulating member 21. Thus, even if the distance between the shielding member 16 and the envelope 1 is shortened, the voltage-withstand performance between the radiation tube 10 and the envelope 1 can be secured, whereby it is possible to achieve reduction of size and weight of the apparatus.

Here, it should be noted that the shape of the shielding member 16 is not limited to that illustrated in FIGS. 1A to 1C. That is, the shielding member may have any shape in which it is possible to secure the voltage-withstand performance by making the shortest distance d2 larger than the shortest distance d1 and such as also makes it possible to shield the unnecessary radiation. Further, the surface of the shielding member 16 on the side of the first window may be identical with the surface of the second window 15 on the side of the first window. Furthermore, it is desirable that the shortest distance d2 is approximately 1.2 times or more the shortest distance d1, although it depends on the driving condition, the constituent member and the like of the radiation generating apparatus.

For the purpose of extracting more radiation from the envelope 1, it is desirable as illustrated in FIGS. 1A and 1B that the shielding member 16 has a shape in which the cross-section area of the radiation passing hole 24 becomes gradually larger from the side of the second window 15 to the side of the first window 2. This is because the radiation transmitted through the second window 15 has a radial spread.

Further, it is desirable that the cross-section area at the end of the radiation passing hole 24 on the side of the first window is larger than the area of the opening 22 of the insulating member 21 and also larger than the area of the first window 2. Furthermore, it is desirable that the respective centers of the first window 2, the opening 22 of the insulating member 21, and the second window 15 are arranged on the same straight line.

As just described, according to the present embodiment, it is possible to provide a radiation generating apparatus which can secure the required voltage-withstand performance for the high voltage used, without reducing the amount of radiation that can be extracted, and the size and weight of which can be reduced.

Incidentally, as illustrated in FIGS. 1A to 1C, the opening 22 of the insulating member 21 is in communication with the first window 2. However, the opening 22 of the insulating member 21 need not be in communication with the first window 2. That is, the insulating member 21 may be apart from the first window 2 and the inner wall of the envelope 1. Even in such a case, it is possible to have the desired effect when the condition of (shortest distance d1)<(shortest distance d2) is satisfied. Further, the opening 22 of the insulating member 21 may be formed outside the boundary of the first window 2 and the envelope 1.

Second Embodiment

In the present invention, the shape of the shielding member 16 is not limited to that illustrated in FIGS. 1A to 1C. That is, another shape may be used as the shape of the shielding member.

Figure 2:
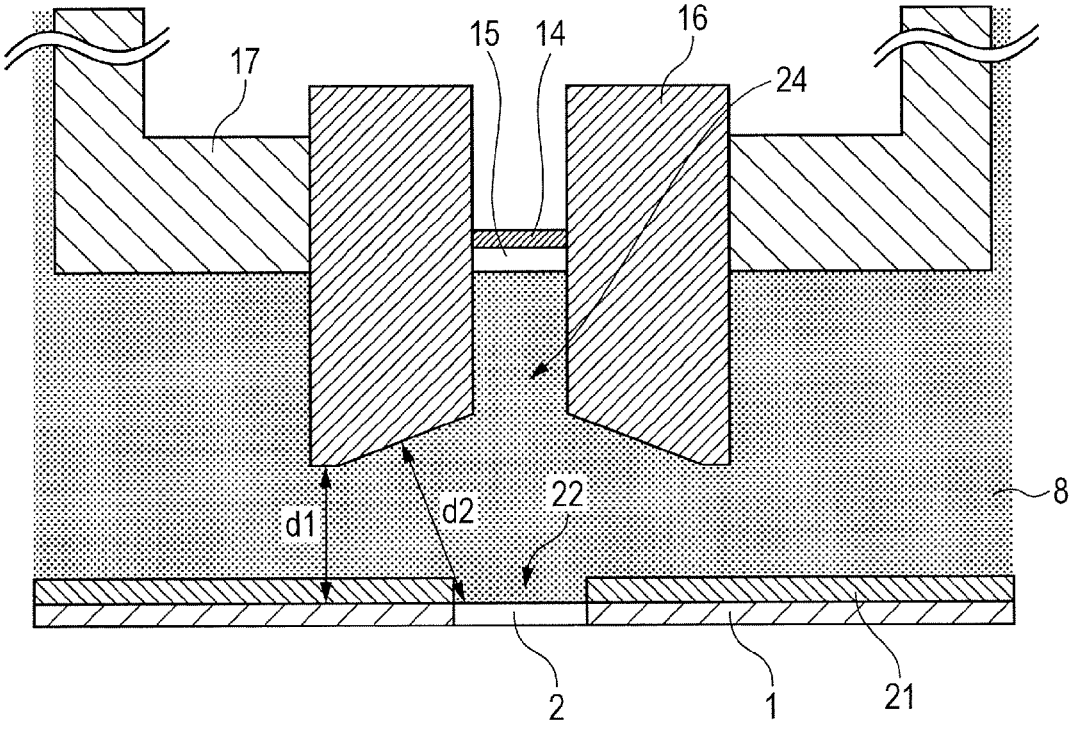
FIG. 2 is a schematic diagram illustrating a peripheral part of a shielding member and an insulating member according to a second embodiment of the present invention.

Therefore, another example of the shape of the shielding member 16 which can be adopted in the present invention will be described with reference to FIG. 2. FIG. 2 is a cross-section schematic diagram illustrating an enlarged peripheral part of the shielding member 16 and the insulating member 21 in a radiation generating apparatus according to the second embodiment of the present invention. It should be noted that, in the present embodiment, the constituent parts other than the shielding member 16 are the same as those already described in the first embodiment.

The present embodiment is characterized by the opening area of the radiation passing hole 24 of the shielding member 16 becoming gradually larger from the middle of the radiation passing hole 24 toward the side of the first window 2. In any case, the shape of the shielding member 16 is as illustrated in FIG. 2 so as to satisfy the relation that the shortest distance d2 is longer than the shortest distance d1. That is, the end of the radiation passing hole 24 on the side of the first window is positioned toward the second window rather than toward the end of the periphery of the shielding member 16.

As just described, according to the present embodiment, since the construction as above is provided, it is possible to have the effect same as that in the first embodiment.

Incidentally, the opening 22 of the insulating member 21 need not be in communication with the first window 2. Further, the insulating member 21 may be apart from the first window 2 and the inner wall of the envelope 1 provided that the condition that (shortest distance d1)<(shortest distance d2) is satisfied. Furthermore, the opening 22 of the insulating member 21 may be formed outside the boundary of the first window 2 and the envelope 1.

Third Embodiment

Figure 3A:
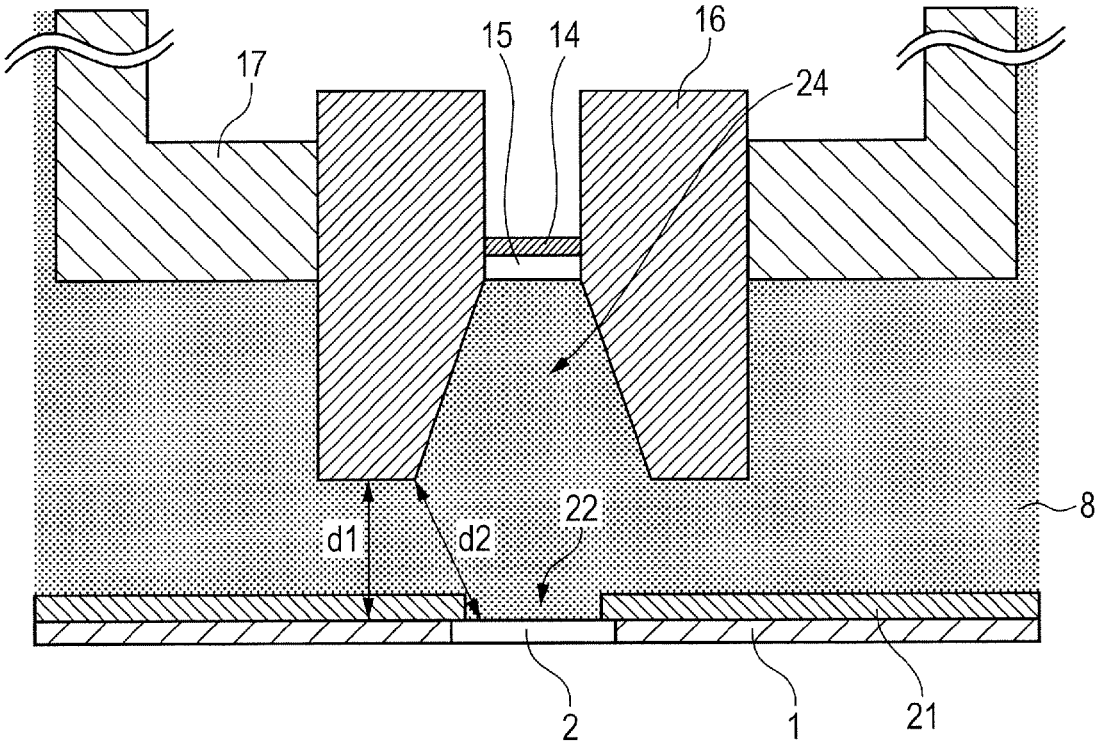
FIGS. 3A and 3B are schematic diagrams illustrating a peripheral part of a shielding member and an insulating member according to a third embodiment of the present invention
Figure 3B:
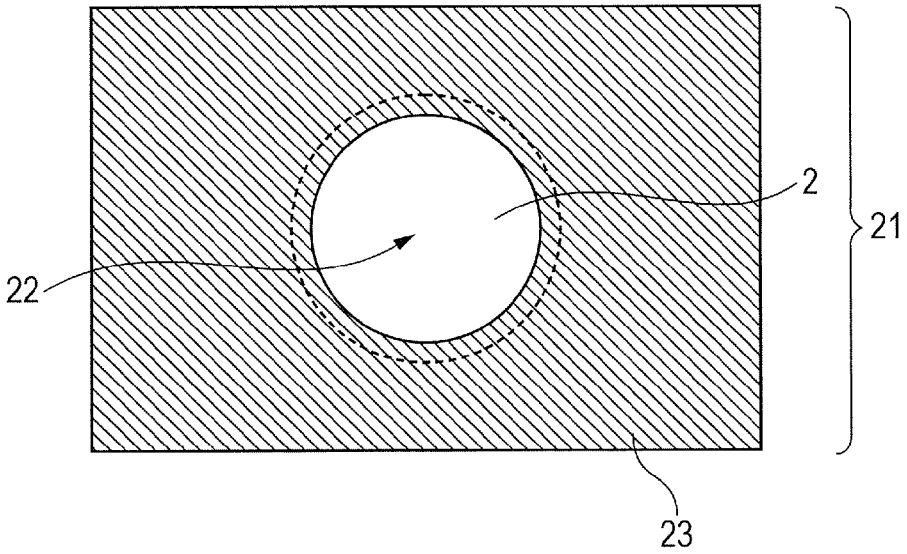

In the present invention, the shape of the insulating member 21 is not limited to that illustrated in FIGS. 1A to 1C Therefore, another example of the shape of the insulating member 21 which can be adopted in the present invention will be described with reference to FIGS. 3A and 3B. FIG. 3A is a cross-section schematic diagram illustrating an enlarged peripheral part of the shielding member 16 and the insulating member 21 in the radiation generating apparatus according to the third embodiment of the present invention, and FIG. 3B is a schematic diagram of the insulating member 21 and the first window 2 which are viewed from the side of the shielding member 16 all illustrated in FIG. 3A. It should be noted that, in the present embodiment, the constituent parts other than the insulating member 21 are the same as those already described in the first embodiment.

The present embodiment is characterized by the opening 22 of the insulating member 21 being formed inside the boundary of the first window 2 and the envelope 1, and thus the boundary of the first window 2 and the envelope 1 is covered by the insulating member 21. That is, when the relevant portion is viewed from the side of the shielding member 16, the opening 22 of the insulating member 21 is positioned inside the boundary of the first window 2 and the envelope 1. Further, the shape of the insulating member 21 is as illustrated in FIGS. 3A and 3B so as to satisfy the relation that the shortest distance d2 is longer than the shortest distance d1. At the boundary of the first window 2 and the envelope 1, the electric field is concentrated easily at the corner or the like of the boundary. For this reason, when the first window 2 is made using an insulating material, a singularity of the electric field appears at the boundary of the first window 2, the envelope 1 and the insulating liquid 8, and consequently there may be a case where a risk for an electric discharge is high at this point. Since the present embodiment has a construction in which the boundary of the first window 2 and the envelope 1—which easily becomes the electric field concentration portion—is covered by the insulating member 21, it is possible further to improve the voltage-withstand performance as between the radiation tube 10 and the envelope 1.

As just described, according to the present embodiment, since the construction as above is provided, it is possible to have the effect the same as that in the first and second embodiments. In addition, it is possible to have the effect of further improving the withstand voltage performance between the radiation tube 10 and the envelope 1.

Incidentally, the opening 22 of the insulating member 21 need not be in communication with the first window 2. Further, the insulating member 21 may be apart from the first window 2 and the inner wall of the envelope 1 provided that the condition (shortest distance d1)<(shortest distance d2) is satisfied. Since it is desired to suppress the occurrence of the electric discharge due to the concentration of the electric field by covering the boundary of the first window 2 and the envelope 1 with the insulating member 21, it is desirable that the insulating member 21 is made not excessively far apart from the first window 2 and the inner wall of the envelope 1. This is because the boundary cannot be covered by the insulating member if the insulating member is made too far apart from the first window and the inner wall of the envelope.

Fourth Embodiment

Figure 4:
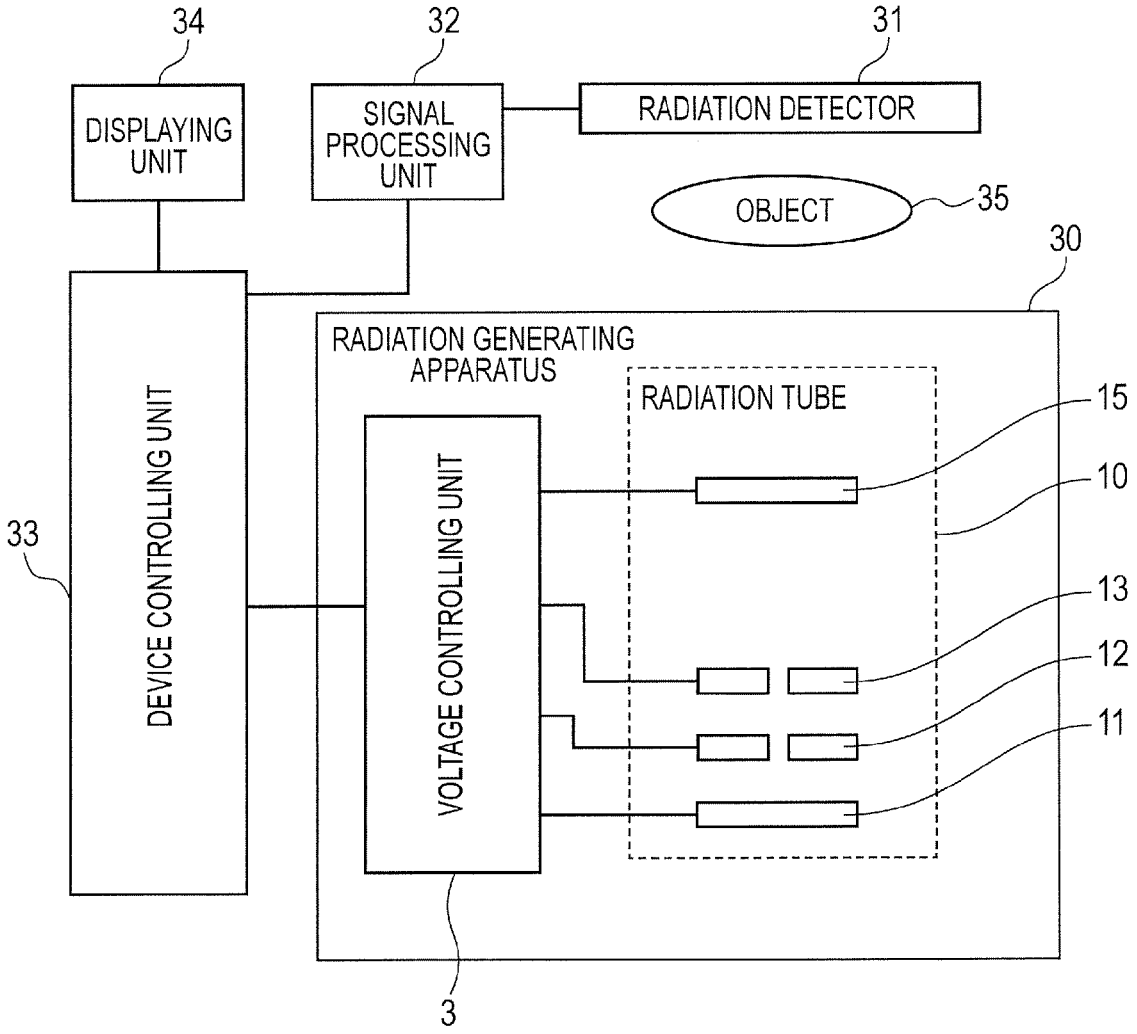
FIG. 4 is a block diagram illustrating a radiation imaging apparatus in which the radiation generating apparatus according to the present invention is used.

Now, a radiation imaging apparatus in which the radiation generating apparatus according to the present invention is used will be described with reference to FIG. 4. FIG. 4 is a block diagram illustrating a radiation imaging apparatus according to the fourth embodiment of the present invention. The radiation imaging apparatus according to the present embodiment is equipped with a radiation generating apparatus 30, a radiation detector 31, a signal processing unit 32, a device controlling unit 33 and a displaying unit 34. Here, for example, the radiation generating apparatus described in each of the first to third embodiments is suitably used as the radiation generating apparatus 30. The radiation detector 31 is connected to the device controlling unit 33 through the signal processing unit 32, and further the device controlling unit 33 is connected to the displaying unit 34 and the voltage controlling unit 3.

The processes to be performed in the radiation generating apparatus 30 are totally controlled by the device controlling unit 33. For example, a radiation imaging process to be performed by the radiation generating apparatus 30 and the radiation detector 31 is controlled by the device controlling unit 33. Radiation emitted from the radiation generating apparatus 30 is detected by the radiation detector 31 after having passed through an object 35, and thus a radiation transmission image obtained from the object 35 is obtained. Then, the imaged radiation transmission image is displayed on the displaying unit 34. Further, for example, driving of the radiation generating apparatus 30 is controlled by the device controlling unit 33, and also the voltage signal to be applied to the radiation tube 10 through the voltage controlling unit 3 is controlled by the device controlling unit 33.

As just described, according to the present embodiment, since the above radiation generating apparatus is used, it is possible to have the above-described effects. In addition, it is possible to provide a radiation imaging apparatus which is suitable for radiation imaging and has excellent reliability even over a long period of time.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-152757, filed Jul. 11, 2011, which is hereby incorporated by reference herein in its entirety.

What is claimed is:

1. An X-ray radiation generating apparatus comprising:

an envelope which has a first window through which X-ray radiation is transmitted;

a radiation tube which is held in said envelope, and has, at a position facing said first window, a second window through which the X-ray radiation is transmitted;

a shielding member which has a radiation passing hole which is in communication with said second window;

an insulating liquid which is filled between said envelope and said radiation tube; and a solid insulating member which is arranged between said shielding member and an inner wall of said envelope, and is apart from said shielding member, and has an opening at a position corresponding to said first window, wherein a shortest length of a supposed straight line stretching from said shielding member to said first window through said opening of said insulating member without intersecting said insulating member or stretching from said shielding member to said inner wall of said envelope through said opening of said insulating member without intersecting said insulating member is longer than a shortest length of a supposed straight line stretching from said shielding member to said first window and intersecting said insulating member or stretching from said shielding member to said inner wall of said envelope and intersecting said insulating member.

2. The radiation generating apparatus according to claim 1, wherein said opening of said insulating member is in communication with said first window.

3. The radiation generating apparatus according to claim 1, wherein an end of said opening of said insulating member is formed inside a boundary of said first window and said envelope.

4. The radiation generating apparatus according to claim 1, wherein an end of said opening of the insulating member coincides with a boundary of said first window and said envelope.

5. The radiation generating apparatus according to claim 1, wherein a cross-sectional area of said radiation passing hole becomes gradually larger from said second window to said first window.

6. The radiation generating apparatus according to claim 1, wherein a cross-sectional area at an end of said radiation passing hole on a side of said first window is larger than an area of said opening of said insulating member.

7. The radiation generating apparatus according to claim 6, wherein said cross-sectional area at said end of said radiation passing hole on the side of said first window is larger than an area of said first window.

8. The radiation generating apparatus according to claim 1, wherein an end of said radiation passing hole on a side of said first window is positioned on a side toward said second window rather than toward an end of a periphery of said shielding member.

9. The radiation generating apparatus according to claim 1, wherein respective centers of said first window, said opening of said insulating member, and said second window are arranged on a straight line.

10. The radiation generating apparatus according to claim 1, wherein said insulating liquid includes an electrically insulating oil.

11. The radiation generating apparatus according to claim 1, wherein said radiation tube includes a vacuum container, an electron emitting source which is arranged within said vacuum container, and a target which is arranged inside said second window and generates the radiation in response to bombardment by an electron emitted from said electron emitting source.

12. The radiation generating apparatus according to claim 11, wherein said shielding member is arranged at an opening of said vacuum container such as to project toward a side of said first window.

13. The radiation generating apparatus according to claim 11, further comprising a voltage controlling unit configured to set a voltage of said target to $+(Va-\alpha)$ volts, and a voltage of said electron emitting source to $-\alpha$ volts (where $Va>\alpha>0$).

14. The radiation generating apparatus according to claim 1, wherein electrical insulation of said insulating member is higher than electrical insulation of said insulating liquid.

15. The radiation generating apparatus according to claim 14, wherein said insulating member is any of polyimide, polycarbonate and glass epoxy.

16. The radiation generating apparatus according to claim 1, wherein said first window is any of glass, aluminum, beryllium and polycarbonate.

17. An X-ray radiation imaging apparatus comprising:

an X-ray radiation generating apparatus which comprises:

an envelope which has a first window through which radiation is transmitted;

a radiation tube which is held in said envelope, and has, at a position facing said first window, a second window through which the X-ray radiation is transmitted;

a shielding member which has a radiation passing hole which is in communication with said second window;

an insulating liquid which is filled between said envelope and said radiation tube; and a solid insulating member which is arranged between said shielding member and an inner wall of said envelope, and is apart from said shielding member, and has an opening at a position corresponding to said first window, wherein a shortest length of a supposed straight line stretching from said shielding member to said first window through said opening of said insulating member without intersecting said insulating member or stretching from said shielding member to said inner wall of said envelope through said opening of said insulating member without intersecting said insulating member is longer than a shortest length of a supposed straight line stretching from said shielding member to said first window and intersecting said insulating member or stretching from said shielding member to said inner wall of said envelope and intersecting said insulating member;

a radiation detector configured to detect the radiation emitted from said radiation generating apparatus and transmitted through an object; and a controlling unit configured to control said radiation generating apparatus and said radiation detector.

* * * * *